US005213516A

United States Patent [19]

Okamoto

[11] Patent Number: 5,213,516

[45] Date of Patent: May 25, 1993

[54] ATTACHMENT PLUG

[75] Inventor: Isao Okamoto, Osaka, Japan

[73] Assignee: Nichido Kogyo Kabushiki Kaisha, Osaka, Japan

[21] Appl. No.: 962,077

[22] Filed: Oct. 16, 1992

Related U.S. Application Data

[63] Continuation of Ser. No. 784,944, Oct. 31, 1991, abandoned.

[30] Foreign Application Priority Data

Nov. 5, 1990 [JP] Japan ..... 2-116466
Oct. 5, 1991 [JP] Japan ..... 3-080945

[51] Int. Cl.[5] ..... H01R 13/652
[52] U.S. Cl. ..... 439/104; 439/171
[58] Field of Search ..... 439/103, 104, 171, 172, 439/174

[56] References Cited

U.S. PATENT DOCUMENTS 2,984,808 5/1961 Bender ..... 439/104
3,219,962 11/1965 Whalen ..... 439/104
3,958,849 5/1976 Blairsdale ..... 439/104

FOREIGN PATENT DOCUMENTS 716234 8/1965 Canada ..... 439/172
376158 9/1964 Switzerland ..... 439/104

*Primary Examiner*—Eugene F. Desmond
*Attorney, Agent, or Firm*—Lowe, Price, LeBlanc & Becker

[57] ABSTRACT

Disclosed herein is an attachment plug which can be inserted in both grounded and nongrounded power plug sockets with no requirement for an adapter. An earth terminal pin is pivotably connected to a holder for the attachment plug at its mounting end, so that the earth terminal pin is pivotable about the pivotally connected portion, when not in use, to be stored entirely in a storage cavity which is formed in a front surface of a holder.

9 Claims, 7 Drawing Sheets

ATTACHMENT PLUG

This application is a continuation of application Ser. No. 07/784,944 filed Oct. 31, 1991, now abandoned.

BACKGROUND OF THE INVENTION

1. Field of the Invention

The present invention relates to an attachment plug which is provided with an earth terminal pin.

2. Description of the Background Art

FIG. 12 is a perspective view showing a conventional attachment plug which is provided with an earth terminal pin. Referring to FIG. 12, a pair of power terminal blades 23 and 24 and an earth terminal pin 25 are mounted on the front surface of a holder 22 for an attachment plug 21. The attachment plug 21 provided with the earth terminal pin 25 is inserted in a grounded power plug socket, which is provided with a pair of slots corresponding to the power terminal blades 23 and 24 as well as a hole of an earth electrode for receiving the earth terminal pin 25. Such a plug socket is mainly used in a factory, on the site of construction, or the like.

In the conventional attachment plug provided with an earth terminal pin as shown in FIG. 12, no problem is caused when the same is inserted only in such a grounded plug socket. However, this attachment plug cannot be inserted in a plug socket which has no hole of an earth electrode for receiving the earth terminal pin 25. A general plug socket for domestic use etc. has no such hole of an earth electrode. Therefore, a problem is caused in relation to an attachment plug for an electric appliance such as a cord reel, which is applicable to domestic use in addition to use in a factory, on the site of construction, or the like.

FIG. 12 shows an adapter 31 which is generally employed to enable insertion of such an attachment plug in the aforementioned two types of power plug sockets. Power terminal blades 33 and 34 are provided on the front surface of a holder 32 for the adapter 31. The holder 32 is further provided on its rear surface with a pair of holes (not shown) for receiving the power terminal blades 23 and 24 of the attachment plug 21, as well as a hole (not shown) for receiving the earth terminal pin 25. The power terminal blades 23 and 24 of the earth terminal pin 25 are inserted in the holes which are provided on the rear surface of the adapter 31, so that the power terminal blades 23 and 24 are electrically connected with the power terminal blades 33 and 34 of the holder 31 while the earth terminal pin 25 is electrically connected with an earth terminal cord 35. Thus, the attachment plug can be inserted in a power plug socket having no earth electrode through the power terminal blades 33 and 34, which are provided on the front surface of the adapter 31. Further, the attachment plug can be grounded through the earth terminal cord 35, if necessary.

However, such an adapter 31 may be lost during use, since the same is not integrated with the attachment plug. Although the adapter 31 may be connected to the attachment plug with a cord or the like so that the former is not separated from the latter, the attachment plug is hard to handle in this case. Even if the adapter is connected to the attachment plug with a strong cord, the same may still be lost during use.

Further, the product cost is increased due to the adapter, which is not integrated with the attachment plug.

SUMMARY OF THE INVENTION

An object of the present invention is to solve the aforementioned problems of the prior art, and provide an attachment plug which can be inserted in both types of grounded and nongrounded power plug sockets with no requirement for an adapter.

The attachment plug according to the present invention has a pair of power terminal blades and an earth terminal pin, which are mounted on the front surface of a holder. The earth terminal pin is pivotally connected to the holder at its mounting end, so that the same is bent up about the pivotally connected portion in a nonused state to be stored in a storage cavity which is formed in the front surface of the holder.

Further, the inventive attachment plug is preferably provided with urging means, which is adapted to urge the earth terminal pin to rotate toward a position for insertion.

In the attachment plug according to the present invention, the earth terminal pin is pivotally connected to the holder at its mounting end, so that the same is bent up at the pivotally connected portion in a nonused state and can be stored entirely in a storage cavity which is formed in the front surface of the holder. The attachment plug can be inserted in a nongrounded power plug socket in this state.

On the other hand, the earth terminal pin is bent down about the pivotally connected portion to project from the front surface of the holder, so that the attachment plug can be inserted in a grounded power plug socket.

When the attachment plug is provided with urging means, the earth terminal pin is urged by this means to rotate toward the position for insertion, whereby the attachment plug can be directly inserted in a grounded power plug socket. In the case of a nongrounded power plug socket, on the other hand, the earth terminal pin is bent up and stored entirely in the storage cavity against urging force of the urging means, whereby the attachment plug can be inserted in the nongrounded plug socket.

In the attachment plug according to the present invention, the earth terminal pin is pivotally connected to the holder at its mounting end, so that the same can be stored entirely in the storage cavity which is provided in the front surface of the holder in a nonused state. Thus, the attachment plug can be inserted in a nongrounded power plug socket. When the earth terminal pin is raised up to project from the front surface of the holder, on the other hand, the attachment plug can be inserted in a grounded power plug socket.

According to the present invention, therefore, the attachment plug can be inserted in both types of grounded and nongrounded power plug sockets with no requirement for an adapter, dissimilarly to the prior art. Thus, it is not necessary to prepare an adapter independently of the attachment plug, whereby the manufacturing cost can be reduced.

Further, the inventive attachment plug may be provided with urging means for urging the earth terminal pin to rotate toward the position for insertion, so that the attachment plug can be easily inserted in both types of grounded and nongrounded power plug sockets with no necessity for manually bending the terminal pin part.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
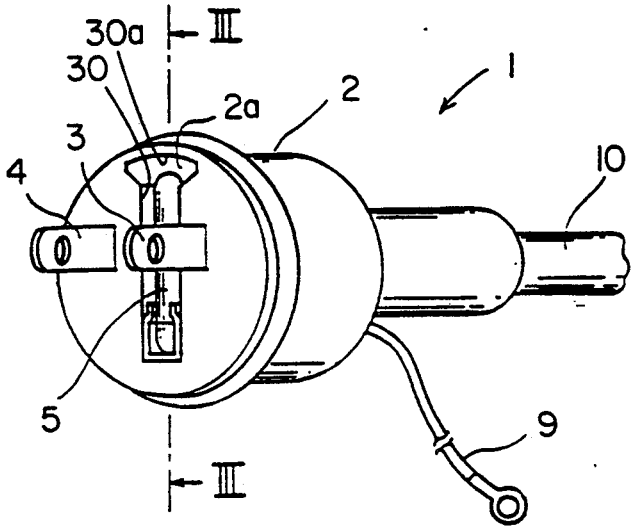
FIG. 1 is a perspective view showing an embodiment of the present invention, whose earth terminal pin is in a nonused state.
Figure 2:
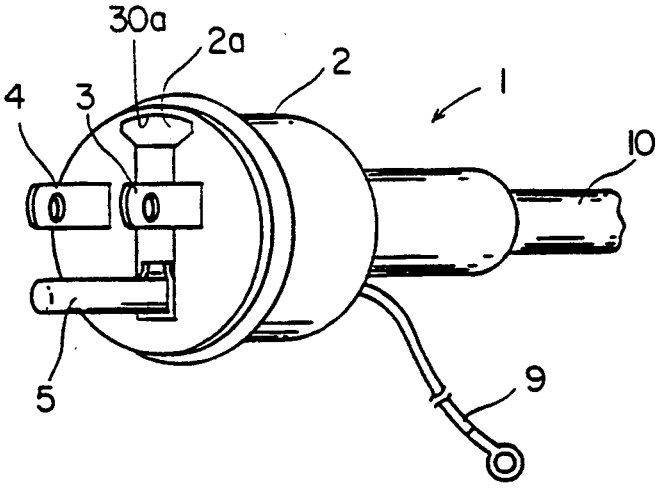
FIG. 2 is a perspective view showing the embodiment of the present invention, whose earth terminal pin is in a used state.

FIG. 1 is a perspective view showing an embodiment of the present invention, whose earth terminal pin is in a nonused state. FIG. 2 is a perspective view showing the embodiment of the present invention, whose earth terminal pin is in a used state.

Figure 3:
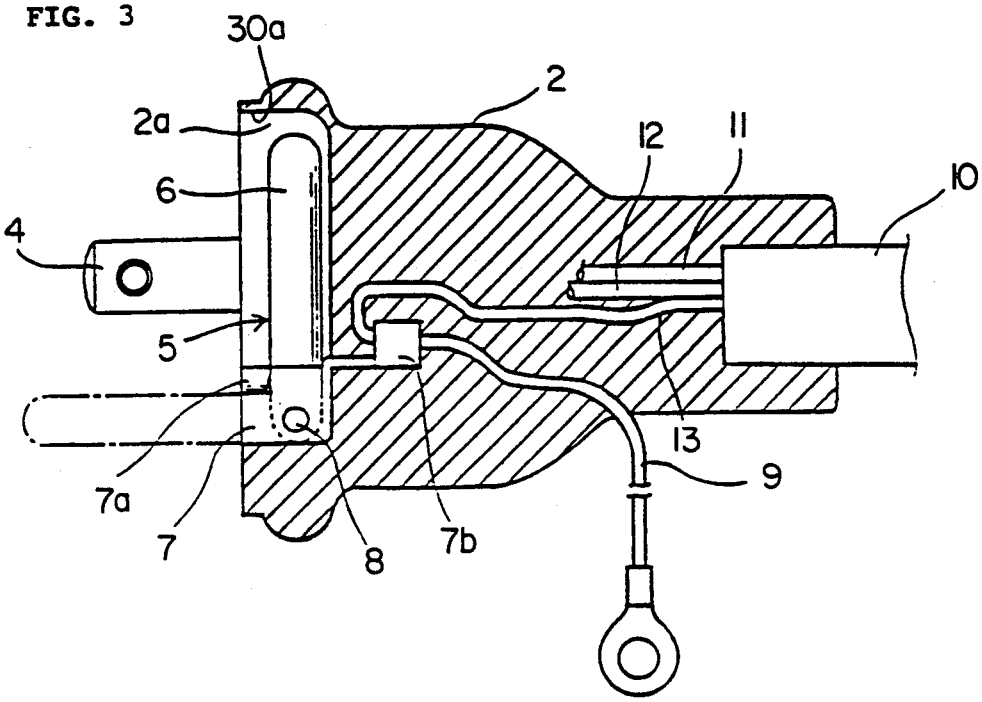
FIG. 3 is a sectional view taken along the line III—III in FIG. 1.
Figure 4:
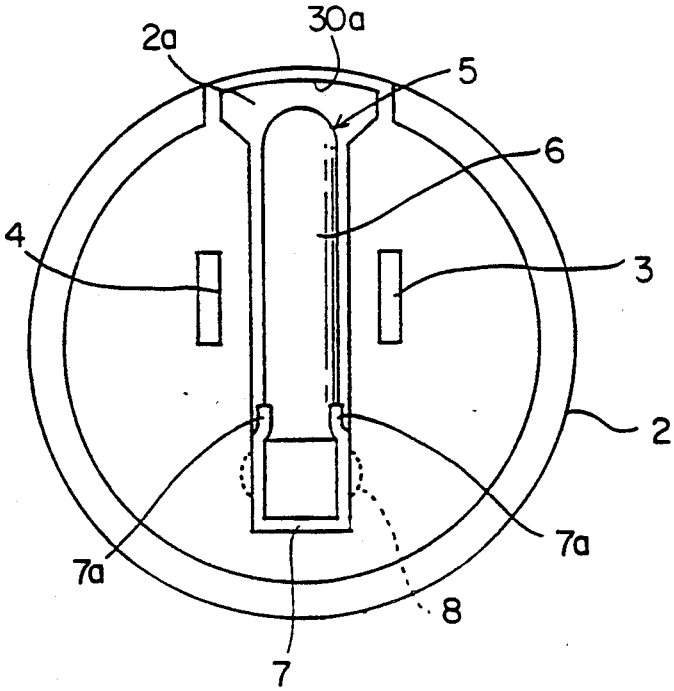
FIG. 4 is a front elevational view of the embodiment shown in FIG. 1.

FIG. 3 is a sectional view taken along the line III—III in FIG. 1. FIG. 4 is a front elevational view of the embodiment shown in FIG. 1.

Referring to FIGS. 1 to 4, a pair of power terminal blades 3 and 4 are provided on the front surface of a holder 2 for an attachment plug 1. Further, an earth terminal pin 5 is pivotally connected at its mounting end to the front surface of the holder 23. The earth terminal pin 5 can be bent up about the pivotally connected portion of the mounting end, so that the earth terminal pin 5 same is stored entirely in a storage cavity 2*a* which is formed in the front surface of the holder 2. The attachment plug 1 can be inserted in an ordinary power plug socket, which is not grounded, in this state. Note that in this state, the earth terminal pin is surrounded all around by a peripheral wall surface 30 of storage cavity 2*a*. Note that a portion 30*a* of this wall surface immediately near the tip end of the stored earth terminal pin is contiguous with the rest of the wall surface 30. Earth terminal pin 5 is thus stored entirely within storage cavity 2*a*. Note that storage cavity 2*a* near and surrounding the distal end portion of stored earth terminal pin is enlarged to facilitate a user's reaching to the earth terminal pin 5 to rotate it outward to its use position as illustrated in FIG. 2 and in phantom lines in FIG. 3.

On the other hand, the earth terminal pin 5 is bent down about the pivotally connected portion of the mounting end to project from the holder 2 as shown in FIG. 2, so that the attachment plug 1 can be inserted in a grounded plug socket.

Referring to FIG. 3, an end of a three-core cable 10 is connected to the holder 2 for the attachment plug 1, so that wires 11 and 12 are connected to the power terminal blade 3 (not shown in FIG. 3) and the other power terminal blade 4 respectively. An earthing wire 13 is connected to a cord connection part 7*b* of a hinge fitting 7 of the earth terminal pin 5. An end of an externally guided earth terminal cord 9 is also connected to the cord connection part 7*b* of the hinge fitting 7.

According to this embodiment, the earth terminal pin 5 is formed by a terminal pin part 6, the hinge fitting 7, and a hinge pin 8.

Figure 5:
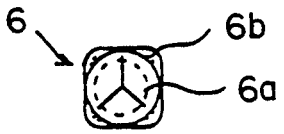
FIG. 5 is a front elevational view showing a terminal pin part of the earth terminal pin provided in the embodiment shown in FIG. 1.
Figure 6:
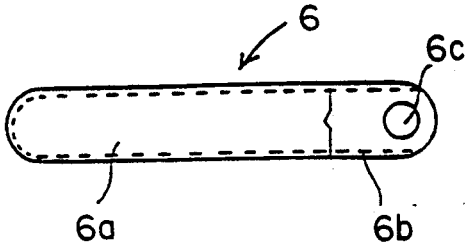
FIG. 6 is a side elevational view showing the terminal pin part of the earth terminal pin provided in the embodiment shown in FIG. 1.
Figure 7:
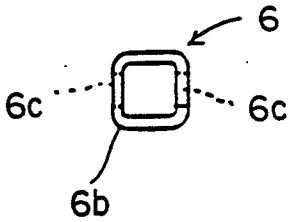
FIG. 7 is a rear elevational view showing the terminal pin part of the earth terminal pin provided in the embodiment shown in FIG. 1.

FIGS. 5 to 7 are front, side and rear elevational views showing the terminal pin part 6 of the earth terminal pin 5 respectively. Referring to FIGS. 5 to 7, a mounting end of the terminal pin part 6 is rectangularly formed to define a tubular part 6*b*. A portion of the terminal pin part 6 between the forward end and the tubular part 6*b* is circularly formed to define a cylindrical part 6*a*. The tubular part 6*b*, which is provided at the mounting end, has holes 6*c*.

Figure 8:
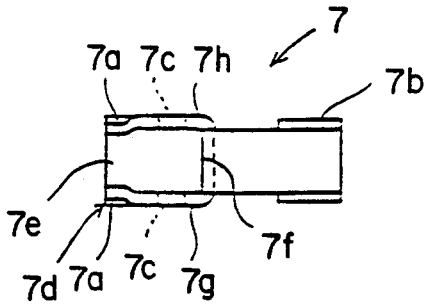
FIG. 8 is a plan view showing a hinge fitting of the earth terminal pin provided in the embodiment shown in FIG. 1.
Figure 9:
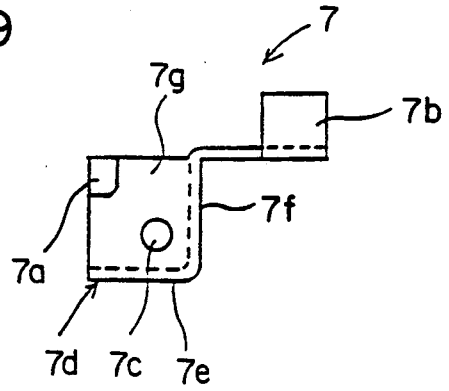
FIG. 9 is a side elevational view showing the hinge fitting of the earth terminal pin provided in the embodiment shown in FIG. 1.

FIGS. 8 and 9 are side elevational views showing the hinge fitting 7 of the earth terminal pin 5. Referring to FIGS. 8 and 9, a hinge part 7*d* of the hinge fitting 7 is formed by a pair of opposite wall surfaces 7*g* and 7*h* and another pair of perpendicular wall surfaces 7*e* and 7*f* which are provided between the wall surfaces 7*g* and 7*h*. The opposite wall surfaces 7*g* and 7*h* are provided with holes 7*c* respectively, while opening corner portions thereof are inwardly depressed to define stop portions 7*a*. The cord connection part 7*b*, which has a U-shaped section, extends from the wall surface 7*f*. This cord connection part 7*b* is caulked to be connected with the earthing wire 13 of the three-core cable 10 and the end of the earth terminal cord 9, as described above.

The terminal pin part 6 is engaged in the hinge fitting 7 so that the holes 6*c* of the former are aligned with the holes 7*c* of the latter, and the hinge pin 8 is inserted in these holes 6*c* and 7*c* as shown in FIG. 3, to pivotally connect the terminal pin part 6 to the hinge fitting 7.

Referring to FIG. 3, the terminal pin part 6 which is pivotally connected to the hinge fitting 7 can be switched between two positions. Since the stop portions 7*a* of the hinge fitting 7 are inwardly depressed, the terminal pin part 6 can be brought into the state shown with solid lines in FIG. 3, i.e., a stored state of the earth terminal pin 5, and a state shown with one-dot chain lines in FIG. 3, i.e., a used state of the earth terminal pin 5. In order to bring the earth terminal pin 5 into the used state shown with one-dot chain lines from the stored state shown with solid lines, a finger or the like is inserted in a clearance which is defined at the forward end of the storage cavity 2*a* of the holder 2, to raise up the forward end of the earth terminal pin 5. At this time, the inwardly depressed stop portions 7*a* are outwardly pressed to raise up the terminal pin part 6. The terminal pin part 6 is effectively located in a completely raised state since the pivotally connected portion thereof is not in contact with the stop portions 7*a* of the hinge fitting 7 as shown by one-dot chain lines in FIG. 3.

In order to store the earth terminal pin 5, the terminal pin part 6 is pressed into the storage cavity 2a. At this time, the stop portions 7a are outwardly pressed so that the terminal pin part 6 rotates about the hinge pin 8. Also in this, case, the terminal pin part 6 is effectively located entirely within storage cavity 2a in the state shown by solid lines in FIG. 3 and the pivotally connected portion thereof is not in contact with the stop portions 7a.

In the attachment plug 1 of this embodiment, as hereinabove described, the earth terminal pin 5 is pivotally connected to the holder 2 at its mounting end so that the same can be stored in the storage cavity 2a which is formed in the front surface of the holder 2 as shown in FIG. 1 when the attachment plug 1 is inserted in a nongrounded power plug socket. On the other hand, the earth terminal pin 5 can be raised up as shown in FIG. 2 when the attachment plug 1 is inserted in a grounded power plug socket. Thus, it is possible to insert the attachment plug 1 in both types of grounded and nongrounded power plug sockets with no requirement for an adapter, dissimilarly to the prior art.

The structure for pivotally connecting the earth terminal pin 5 to the holder 2 is not restricted to that in the aforementioned embodiment, but any other structure may alternatively be employed so far as the earth terminal pin 5 can be raised up for use while the same can be stored entirely in the storage cavity 2a when the same is not used.

According to the present invention, urging means may be provided for urging an earth terminal pin to rotate toward a position for insertion.

Figure 10:
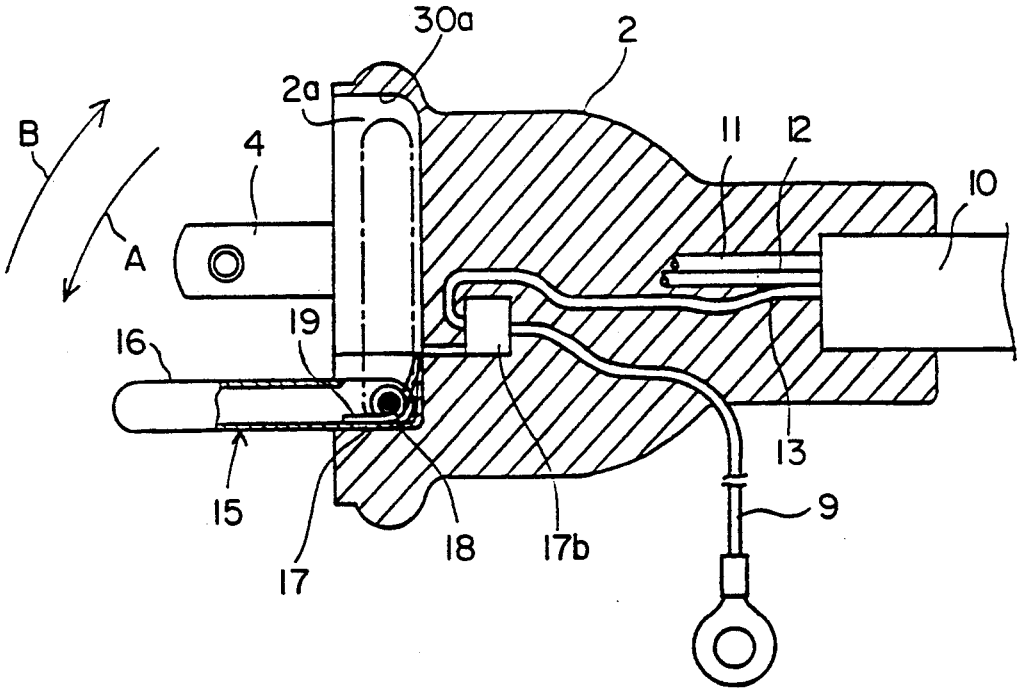
FIG. 10 is a sectional view corresponding to FIG. 3, showing another embodiment of the present invention.

FIG. 10 is a sectional view showing another embodiment of the present invention, which is provided with such urging means. Referring to FIG. 10, a coil spring 19 is provided as means for urging an earth terminal pin 15 to rotate in a direction A. A terminal pin part 16 is urged by the coil spring 19 to rotate toward a position for insertion, so that the earth terminal pin 15 projects from a holder 2 in an ordinary state, as shown in FIG. 10.

Figure 11:
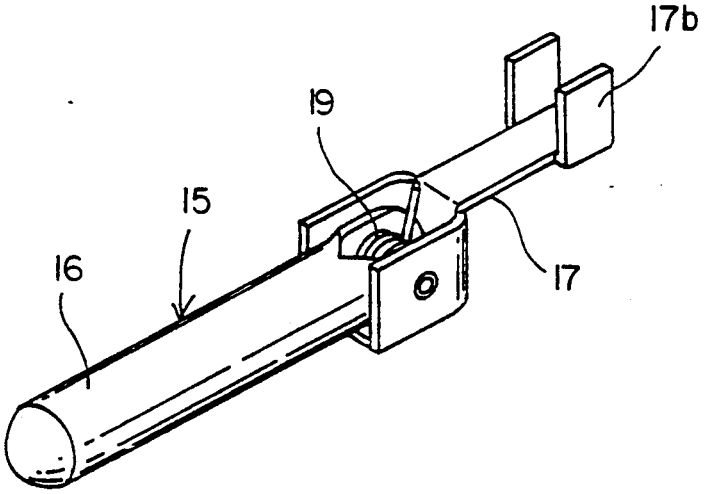
FIG. 11 is a perspective view showing an earth terminal pin and a hinge fitting provided in the embodiment shown in FIG. 10.
Figure 12:
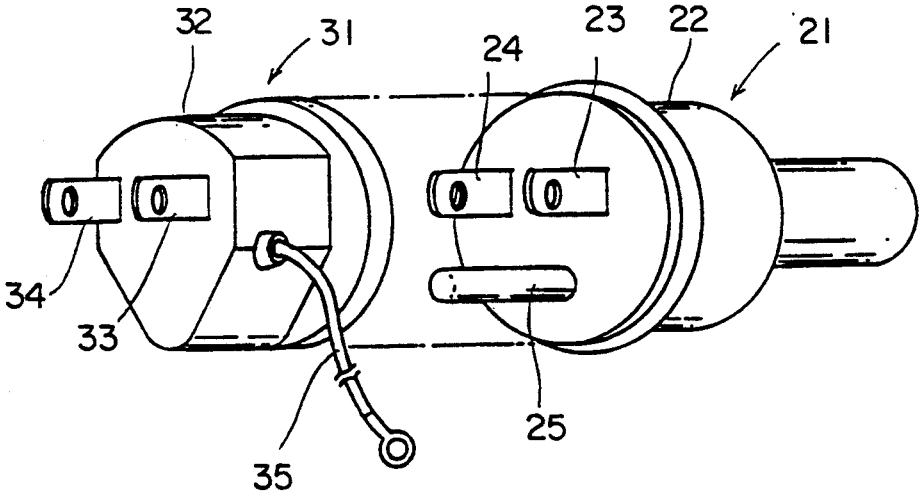
FIG. 12 (PRIOR ART)
FIG. 12 is a perspective view showing a conventional attachment plug provided with an earth terminal pin and an adapter therefor.

FIG. 11 is a perspective view showing the earth terminal pin 15 and a hinge fitting 17 provided in the embodiment shown in FIG. 10. Referring to FIGS. 10 and 11, the coil spring 19 receives a hinge pin 18. According to this embodiment, the hinge fitting 17 has no inwardly depressed portions such as the stop portions 7a of the hinge fitting 7 shown in FIG. 3. When the terminal pin part 16 is pressed in a direction B against the force of the coil spring 19, therefore, the earth terminal pin 15 can be stored entirely in a storage cavity 2a which is formed in the holder 2. When no such pressing force is applied, on the other hand, the terminal pin part 16 is urged by the coil spring 19 to rotate in a direction A and reach the position for insertion.

According to this embodiment, the terminal pin part 16 is generally located in the position for insertion due to the urging force of the coil spring 19, so that the attachment plug can be directly inserted in a grounded power plug socket. In the case of a nongrounded power plug socket, on the other hand, the attachment plug is so inclined that the terminal pin part 16 is stored entirely in the storage cavity 2a while power terminals 3 and 4 are inserted in slots of the plug socket, whereby the terminal pin part 16 is bent up against the urging force of the coil spring 19, to be stored entirely in the storage cavity 2a.

In this embodiment, the urging force of the coil spring 19 must be selected at an appropriate level, which is not too strong nor too weak, since the terminal pin part 16 is inserted in the power plug socket against the urging force of the coil spring 10 as hereinabove described.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An attachment plug, comprising:

a holder provided with a storage cavity in a front surface, said storage cavity having a continuous peripheral wall;

a one-piece grounded earth terminal pin, shaped and sized to be entirely receivable inside said cavity to be surrounded by said peripheral wall thereof, and having an end portion pivotably mounted at the front surface of said holder;

said end terminal pin being pivotable about the pivotally connected portion when not in use to be entirely received within and stored in said storage cavity.

2. An attachment plug, comprising:

a holder provided with a storage cavity in a front surface, said cavity having a continuous peripheral wall;

a pair of power terminal blades provided on the front surface of said holder;

an earth terminal pin, shaped and sized to be entirely receivable inside said cavity to be surrounded by said peripheral wall thereof, and having an end pivotably mounted at the front surface of said holder; and urging means for urging said earth terminal pin to rotate toward a position for insertion;

said earth terminal pin being pivotable about the pivotally connection portion, when not in use, to be entirely received within and stored in said storage cavity.

3. An attachment plug according to claim 2, wherein: said urging means comprises a spring.

4. An attachment plug according to claim 1, wherein: said storage cavity is formed to be enlarged and widened around a portion around a distal end of said earth terminal pin in stored state, to facilitate a user's reaching to rotate said earth terminal pin from said stored plate to project outwardly in a user state thereof.

5. An attachment plug according to claim 2, wherein: said storage cavity is formed to be enlarged and widened around a portion around a distal end of said earth terminal pin in stored state, to facilitate a user's reaching to rotate said earth terminal pin from said stored state to project outwardly in a user state thereof.

6. An attachment plug according to claim 1, further comprising:

a hinge fitting element for pivotably supporting said earth terminal pin, said hinge fitting element having stop portions formed to coact with and hold said earth terminal pin in a stored state as well as a use state.

7. An attachment plug according to claim 2, wherein:

said urging means comprises a torsion spring positioned around a pivot pin pivotably supporting said earth terminal pin to said holder.

8. An attachment plug according to claim 6, wherein: said storage cavity is formed to be enlarged and widened around a portion around a distal end of said earth terminal pin in stored state, to facilitate a user's reaching to rotate said earth terminal pin from said stored state to project outwardly in a user state thereof.

9. An attachment plug according to claim 8, wherein: said urging means comprises a torsion spring positioned around a pivot pin pivotably supporting said earth terminal pin to said holder.

* * * * *